US010636551B2

(12) United States Patent
Okumura et al.

(10) Patent No.: US 10,636,551 B2
(45) Date of Patent: Apr. 28, 2020

(54) RESISTOR ELEMENT

(71) Applicant: Tomoegawa Co., Ltd., Tokyo (JP)

(72) Inventors: Katsuya Okumura, Tokyo (JP); Kazuhiro Eguchi, Shizuoka (JP); Daisuke Muramatsu, Shizuoka (JP)

(73) Assignee: Tomoegawa Co., Ltd., Tokyo (JP)

( * ) Notice: Subject to any disclaimer, the term of this patent is extended or adjusted under 35 U.S.C. 154(b) by 0 days.

(21) Appl. No.: 16/468,785

(22) PCT Filed: Jan. 11, 2018

(86) PCT No.: PCT/JP2018/000466
§ 371 (c)(1),
(2) Date: Jun. 12, 2019

(87) PCT Pub. No.: WO2018/131644
PCT Pub. Date: Jul. 19, 2018

(65) Prior Publication Data

US 2019/0348200 A1 Nov. 14, 2019

(30) Foreign Application Priority Data

Jan. 16, 2017 (JP) ..... 2017-004909

(51) Int. Cl.
*H01C 3/10* (2006.01)
*H01C 7/22* (2006.01)
(Continued)

(52) U.S. Cl.
CPC ..... *H01C 3/10* (2013.01); *H01C 1/012* (2013.01); *H01C 7/22* (2013.01); *H01C 13/00* (2013.01); *H01C 17/07* (2013.01)

(58) Field of Classification Search
CPC . H01C 3/10; H01C 1/012; H01C 7/22; H01C 17/07
(Continued)

(56) References Cited

U.S. PATENT DOCUMENTS 7,291,391 B2 * 11/2007 Watson ..... D02G 3/12 428/375
7,514,021 B2 * 4/2009 Miyagawa ..... H01B 1/24 252/500
(Continued)

FOREIGN PATENT DOCUMENTS

JP 03177696 A 8/1991
JP 2000156305 A 6/2000
(Continued)

OTHER PUBLICATIONS

JP 03-177696, Ogawa et al. (Year: 1991).*
PCT Office, International Search Report issued in corresponding PCT/JP2018/000466 dated Mar. 27, 2018, 3 pages.

*Primary Examiner* — Kyung S Lee
(74) *Attorney, Agent, or Firm* — Wood Herron & Evans LLP

(57) ABSTRACT

An object of the present invention to provide a resistor element which can be mounted at a higher density and can cope with a wide range of resistance values, the present invention provides a resistor element including a resistor which mainly contains metal fibers, electrodes which are formed at an end portion of the resistor, and an insulating layer which is in contact with the resistor and the electrodes.

9 Claims, 8 Drawing Sheets

(51) Int. Cl.
*H01C 17/07* (2006.01)
*H01C 1/012* (2006.01)
*H01C 13/00* (2006.01)

(58) Field of Classification Search
USPC ..... 338/283
See application file for complete search history.

(56) References Cited

U.S. PATENT DOCUMENTS 9,296,640 B2 * 3/2016 De Ridder ..... C03B 23/0252
9,543,552 B2 * 1/2017 Haspel ..... B29C 45/0013

FOREIGN PATENT DOCUMENTS

JP 2003318004 A 11/2003
JP 2004128000 A 4/2004
JP 2005197394 A 7/2005
JP 2006157086 A 6/2006
JP 2009289770 A 12/2009

* cited by examiner

RESISTOR ELEMENT

FIELD OF THE INVENTION

The present invention relates to a resistor element, and in particular to a resistor element suitable for high density mounting.

BACKGROUND ART

Miniaturized electronic components are beginning to be used in wiring plates for electrical and electronic devices. However, there is a demand for further miniaturization of electronic components, and for this purpose, there is an increasing demand for higher density packaging than before in a limited space.

In such a background, as a metal plate resistor element having a compact chip type structure which can obtain a relatively high resistance value, a metal plate resistor which includes a flat plate resistor, and a pair of electrodes connected to both end portions of the flat plate resistor and disposed separately at a lower side of the flat plate resistor, and the flat plate resistor is fixed to the electrodes through an insulating layer has been suggested (Patent Document 1).

In addition, as a metal resistor element which has wide range of resistance values and is miniaturized, a metallic resistor including a resistor which is made of a plate-shaped resistance alloy material and a pair of electrodes made of a highly conductive metallic material which are formed at both end portions of the resistor, wherein a joining part for connecting both end portions of the resistor to the electrodes is provided with two surfaces as a joining surface (for example, Patent Document 2).

Furthermore, as a resistor element for current detection, which has a small size and a compact size, good heat dissipation, high accuracy, and stable operation, a resistor element in which a resistor made of a metal foil is connected to a base plate through an insulating layer has been proposed (for example, Patent Document 3).

PRIOR ART DOCUMENTS

Patent Document

Patent Document 1: Japanese Unexamined Patent Application, First Publication 2004-128000

Patent Document 2: Japanese Unexamined Patent Application, First Publication 2005-197394

Patent Document 3: Japanese Unexamined Patent Application, First Publication 2009-289770

SUMMARY OF INVENTION

Problems to be Solved

However, even with the above-mentioned prior art, it cannot be said that sufficient miniaturization can be achieved in response to the demand for high-density mounting, and there is still room for improvement.

That is, in the technique of Patent Document 1. the method of downsizing is only to devise the arrangement of the resistor portion, the insulating layer, the electrode, and the like, and these structures themselves are the same as conventional ones. There was room for improvement.

The resistance element of Patent Document 2 aims at downsizing by devising the arrangement of the resistor, an insulating layer, the electrodes and the like, and enables the electrode portion to function as a resistor, thereby making it possible to cope with a wide range of the resistance values. However, since the resistor and the insulating layer are the same as conventional ones, there is still room for improvement in size reduction and handling of a wide range of the resistance values.

The resistance, element of Patent Document 3 has a structure in which the resistor made of a metal foil is joined to the base plate via the insulating layer. The point of miniaturization is usage of an epoxy-based adhesive having both high thermal conductivity and high insulation by containing a large amount of alumina pow der. There is still room for improvement in points other than the use of such an epoxy-based adhesive.

Therefore, the present invention has been made in view of the above circumstances, and it is an object of tire present invention to provide a resistor element which can be mounted at a higher density and can cope with a wide range of resistance values.

Problem to be Solved by the Invention

As a result of intensive studies, the present inventors have found that a resistor element including a resistor which mainly contains metal fibers, electrodes which are formed at an end portion of the resistor, and an insulating layer which is in contact with the resistor and the electrodes; and a resistor element including a connection portion, first and second resistors which mainly contains metal fibers and electrically connected to each other at the connection portion, an electrode which is electrically connected to at least one of the first resistor and the second resistor, and an insulating layer which prevents an electrical connection between the first resistor and the second resistor, can cope with the miniaturization of the resistor element and a wide range of resistance value, and achieve resistor elements of the present invention.

Means for Solving the Problem

That is the present invention provides the following resistor elements.

(1) A resistor element including:

a resistor which mainly contains metal fibers;

electrodes which are formed at an end portion of the resistor; and an insulating layer which is in contact with the resistor and the electrodes.

(2) The resistor according to (1), wherein the resistor has a first region exhibiting plastic deformation and a second region exhibiting elastic deformation which appears in a region in which a compressive stress is higher than a compressive stress in the first region in a relationship between a compressive stress and a strain.

(3) The resistor element according to (1), wherein the resistor has an inflection portion a of strain with respect to the compressive stress in the second region exhibiting elastic deformation.

(4) The resistor element according to any one of (1) to (3), wherein the resistor is a stainless fiber sintered body.

(5) A resistor element including:

a connection portion;

first and second resistors which mainly contain metal fibers and are electrically connected to each other at the connection portion;

an electrode which is electrically connected to at least one of the first resistor and the second resistor; and an insulating layer which prevents an electrical connection between the first resistor and the second resistor, and an application direction of voltage of the first resistor and an application direction of voltage of the second resistor are different from each other.

(6) The resistor element according to (5), wherein the connection portion, the first resistor, and the second resistor are continuous.

(7) The resistor element according to (5) or (6), wherein the application direction of voltage of the first resistor and the application direction of voltage of the second resistor are opposed or substantially opposed each other.

(8) The resistor according to any one of (5) to (7), wherein the first resistor and the second resistor have a first region exhibiting plastic deformation and a second region exhibiting elastic deformation which appears in a region in which a compressive stress is higher than a compressive stress in the first region in a relationship between a compressive stress and a strain.

(9) The resistor element according to any one of (5) to (7), wherein the first resistor and the second resistor have an inflection portion a of strain with respect to compressive stress in the second region exhibiting elastic deformation.

(10) The resistor element according to any one of (5) to (7), wherein the first resistor and the second resistor are a stainless fiber sintered body.

Effects of the Invention

The resistor elements of the present invention can achieve further high density mounting by miniaturizing, and can cope with a wide range of the resistance value.

Furthermore, when the application direction of voltage of the first resistor and the application direction of voltage of the second resistor are opposed or substantially opposed each other, generation of an electromagnetic wave can also be suppressed.

DETAILED DESCRIPTION OF THE PREFERRED EMBODIMENTS

Hereinafter, a resistor element of the present invention using a stainless steel material as a resistor will be described with reference to the drawings and photographs, but the embodiment of the resistor element of the present invention is not limited thereto.

First Embodiment

Figure 1:
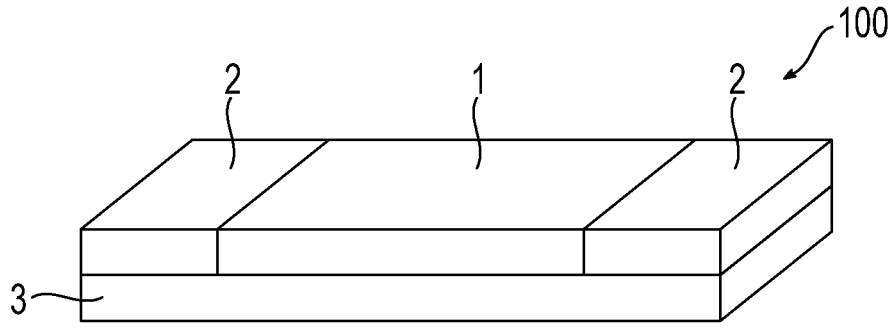
FIG. 1 is a schematic view showing one embodiment of a resistor element of the present invention.

FIG. 1 is a schematic view showing one embodiment of a resistor element of the present invention. A resistor element 100 shown in FIG. 1 includes a resistor 1 which mainly contains metal fibers, electrodes 2 and 2 which are provided at both end portions of the resistor 1, and an insulating layer 3 which is laminated to the resistor 1 and the electrodes 2 and 2.

Second Embodiment

Figure 2:
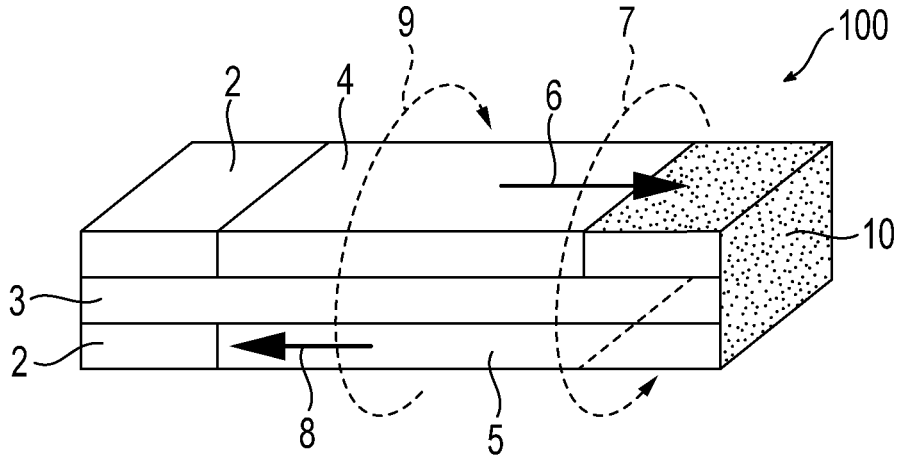
FIG. 2 is a schematic view of another embodiment of a resistor element in which a first resistor and a second resistor are connected by a connection portion according to the present invention.

FIG. 2 is a schematic view showing another embodiment of a resistor element in which a first resistor 4 and a second resistor 5 are electrically connected by a connection portion 10. In the present embodiment, the electrodes 2 and 2 are formed at the end portion of the first resistor 4 and the second resistor 5, and the first resistor 4 and the second resistor 5 are electrically connected to each other at the connection portion 10. In addition, an insulating layer 3 is disposed in order to prevent the first resistor 4 and the second resistor 5 from being electrically connected other than the connection portion 10. By adopting such a structure, the miniaturization of the resistor clement can be realized, which can contribute to high-density mounting. At the same time, since the application direction of voltage of the first resistor 4 is different from the application direction of voltage of the second resistor 5 (in the present embodiment, the application directions are opposite each other), it is possible to offset the magnetic field, and contribute to supress the electromagnetic wave generated from the resistor element itself.

In FIG. 2, the reference number 6 means the direction of the current flowing through the first resistor 4, and the reference number 7 means the magnetic field generated thereby. The reference number 8 means the direction of the current flowing through the second resistor 5, and the reference number 9 means the magnetic field generated thereby.

Further, inn the present description, "opposite or substantially opposite each other" means an aspect in which the offset effect of the magnetic field is generated by the arrangement of the resistors, in addition to the aspect in which the voltage application directions of the first and second resistors are exactly opposite each other.

Third Embodiment

In addition, the first resistor 4, the second resistor 5, and the connection portion 10 may be continuous. In the present description, a continuous body refers to a state in which the other member is used to form the continuous both without binding in addition to a state in which one member is bent.

Figure 3:
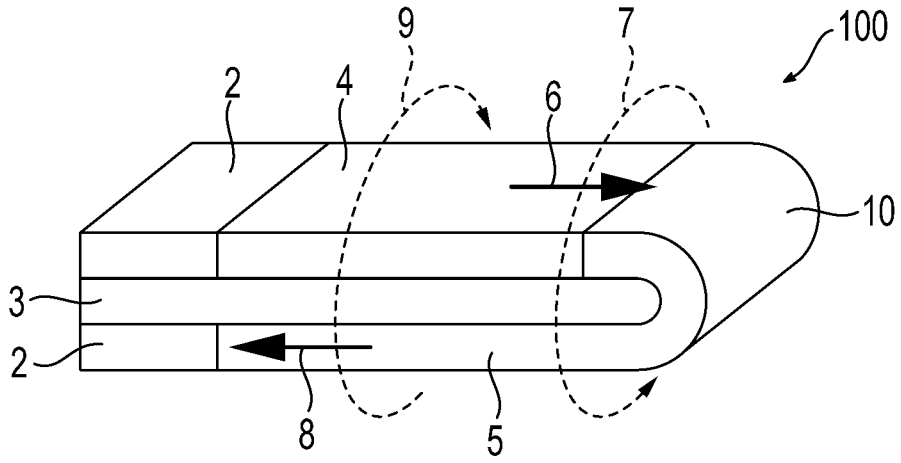
FIG. 3 is a schematic view of another embodiment of a resistor element in which a first resistor, a second resistor, and a connection portion are continuous according to the present invention.

FIG. 3 shows a structure in which the first resistor 4, the second resistor 5, and the connection portion 10 are continuous. With such a structure, it is possible to eliminate the trouble of providing the connection portion 10 as in the embodiment shown in FIG. 2, which can contribute to of production of the resistor element.

In FIG. 3, the reference number 6 means the direction of the current flowing through the first resistor 4 and the reference number 7 means the magnetic field generated thereby. The reference number 8 means the direction of the current flowing through the second resistor 5, and the reference number 9 means the magnetic field generated thereby.

The connection portion in the present embodiment indicates a curved portion connecting the first resistor 4 and the second resistor 5. When producing the resistor element shown in FIGS. 3, 4, and 5, the resistor element can be produced efficiently by bending the continuous body along the insulating layer 3.

Figure 4:
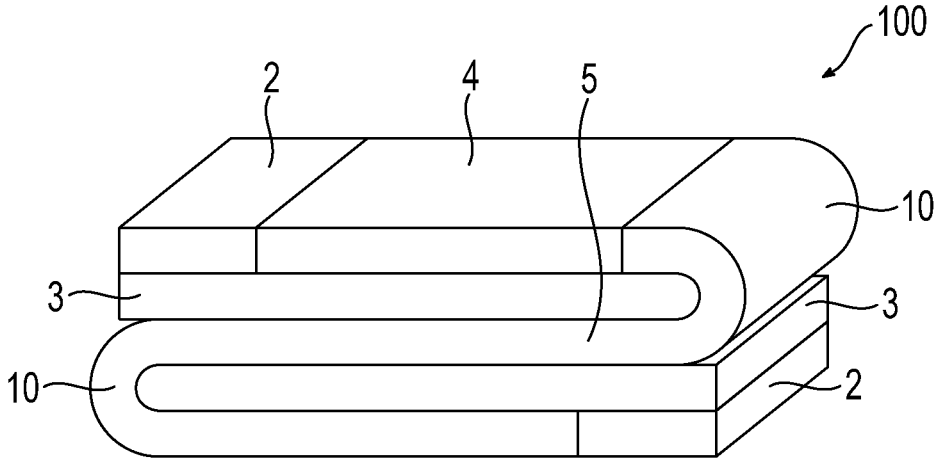
FIG. 4 is a schematic view of another embodiment of a resistor element in which a resistor is alternately bent in three according to the present invention.
Figure 5:
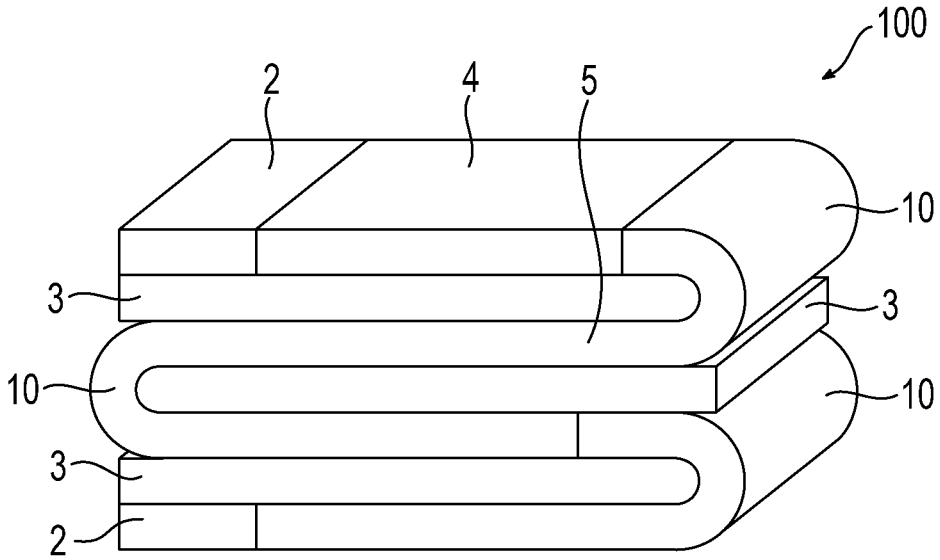
FIG. 5 is a schematic view of another embodiment of a resistor element in which a resistor is alternately bent in four according to the present invention.

FIGS. 4 and 5 show the resistor element in which the resistor 1 which is the continuous body is alternately bent in three and four respectively. The insulating layer 3 is provided between the resistor 1 and the resistor 1. It is possible to expect elects of reducing the size of the resistor element and making it easy to respond to a wide range of the resistance value by adopting a structure in which the resistors are stacked by sandwiching the insulating layer 3 therebetween.

Next, detailed descriptions will be given below for the resistors 1, 4, and 5, the electrode 2, the insulating layer 3 and the like constituting the resistor element 100 of the present invention.

(Resistor 1, 4, and 5)

The resistor 1, 4 and 5 mainly contains metal fibers. The first metal which is the main metal of the metal fibers is, for example, stainless steel, aluminum, brass, copper, iron, platinum, gold, tin, chromium, lead, titanium, nickel, manganin, nichrome, and the like. Stainless steel fibers can be suitably used from the viewpoint of electrical resistivity and economy. Further, the resistor mainly containing metal fibers used in the present invention may be made of only metal fibers or may contain a component other than the metal fibers. Furthermore, metal fibers may be a one kind or a plurality of kinds.

That is, the resistor 1, 4 and 5 in the present invention may be a resistor which is made of metal fibers composed of plural types of stainless steel materials, or may be a resistor which is made of metal fibers composed of stainless steel materials and other metals. In other words, the resistor 1, 4, and 5 may be a resistor made of mewl fibers composed of a plurality of types of metals including stainless steel, a resistor made, of metal fibers composed of a metal nut containing stainless steel, or a resistor containing a component other than metal fibers.

Further, a second metal component is not particularly limited, and examples of the second metal include stainless, iron, copper, aluminum, bronze, brass, nickel, chromium. The second metal may also be noble metal, such as gold, platinum, silver, palladium, rhodium, iridium, ruthenium, and osmium.

The resistor 1, 4 and 5 used in the present invention is preferably a sheet containing mainly the metal fibers. The sheet-shaped material mainly containing the metal fibers refers to a metal fiber nonwoven fabric and a metal fiber mesh (metal fiber woven fabric).

The metal fiber nonwoven fabric may be produced by either a wet method or a dry method. The metal fiber mesh includes, for example, woven fabrics (metal fiber woven fabrics) and the like.

In the present description, "mainly containing metal fibers" refers to a case in which metal fibers are contained at a weight ratio of 50% or more with respect to the resistor.

The metal fibers constituting the resistor 1, 4 and 5 used in the present invention are preferably sintered or bonded to each other by the second metal component from the view point of stabilization and equalization of resistance value. In the present description, "bonded" refers to a state in which the metal fibers are physically fixed by the second metal component.

The average diameter of the metal fibers used in the present invention can be arbitrarily set within a range that does not affect the formation of the resistor and the production of the resistor element. The average diameter of the metal fibers is preferably 1 μm to 50 μm, and more preferably 1 μm to 20 μm.

In the present description, "average diameter of fibers" means an average value which is obtained by calculating the cross-sectional area of an arbitrary number (for example, 20) of metal fibers in a vertical cross-section at an arbitrary part of the resistor imaged by a microscope (for example, with known software), and calculating the diameter of a circle having the same area as the cross-sectional area.

The cross-sectional shape of the metal fibers may be any shape such as a circle, an ellipse, a substantially square, or an irregular shape.

The length of the metal fibers used in the present invention is preferably 1 mm or more. When the length of the metal fibers is 1 mm or more, it is easy to obtain entanglement or contact points between metal fibers even when the resistor is produced by a wet sheet-forming method.

In the present description, the "average length of fibers" is a value obtained by measuring 20 fibers with a microscope and averaging the measured values.

Moreover, it can be expected to obtain the effect of making it easy to set a wide range of resistance value while realizing downsizing of the resistor element and the resistor without adjusting the size of the resistor and the like by adjusting the fiber diameter and fiber length of metal fibers.

The thicknesses of the resistor 1, 4 and 5 can be arbitrarily set by desired values.

In the present description, "the thickness of resistor" means an average value of an arbitrary number of measurement points which are measured by a fit in thickness meter (for example, Mitutoyo manufactured by Mitutoyo: Digimatic indicator ID-C112X) using a terminal drop method with air.

The space factor of the fibers in the resistor 1, 4 and 5 is preferably in a range of 1 to 40%, and more preferably 3 to 20%. By adjusting the space factor, it can be expected to obtain the effect of making it easy to cope with a wide range of resistance value while realizing downsizing of the resistor element and the resistor without adjusting the size of the resistor, and the like. That is, it is possible to adjust the cross-sectional area of the resistor by adjusting the space factor. Therefore, for example, it is possible to adjust to different resistance values even when the size of he resistors are the same.

The "space factor" in the present description is the ratio of the potion where fibers are present with respect to the total volume of the resistor. When the resistor 1, 4 and 5 is a sheet-shaped material, and the resistor is made of only metal fibers, the space factor can be calculated from the basis weight and the thickness of the resistor, and the true density of the metal fibers according to the following equation.

Space factor (%)=basis weight of resistor/(thickness of resistor×true density of metal fibers)×100

In the case in which other metal is used to bond the metal fibers or a component other than metal fibers is used, the ratio of the other metals in the resistor or the ratio of the component other than the metal fibers is specified by composition analysis, and reflecting to the true specific gravity.

The elongation percentage of the resistor 1, 4 and 5 used in the present invention is preferably 2 to 5%. For example, when the resistor is bent along the insulating layer, if the resistor has an appropriate elongation, the outside of the bent portion of the resistor can extend, and easily follow the insulating layer without buckling.

The elongation percentage can be measured at a tensile speed of 30 mm/min by adjusting the area of the test piece to be 15 mm*180 mm according to JIS P8113 (ISO 1924-2).

Figure 14:
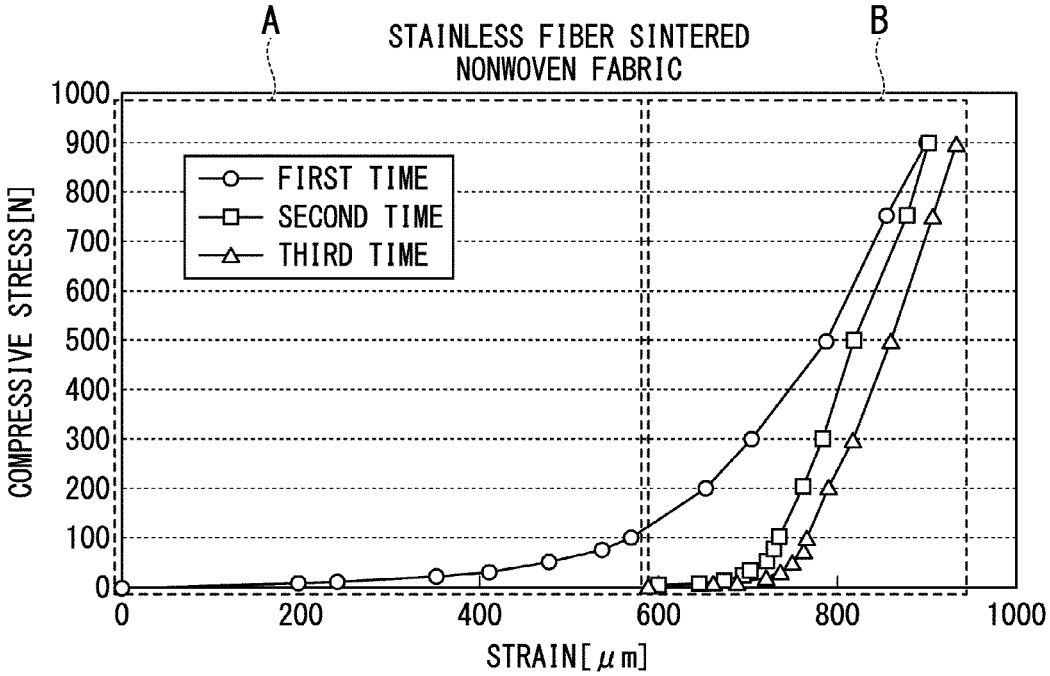
FIG. 14 is a graph showing a relationship between compressive stress and strain of a stainless fiber sintered nonwoven fabric which is an example of a resistor used in the present invention.

FIG. 14 is a graph showing a relationship between the compressive stress and the strain when the resistor included in the resistor element of the present invention is made of a stainless fiber sintered nonwoven fabric. The elongation percentage of the resistor used here is 2.8%.

The resistor 1, 4 and 5 used in the present invention preferably has a first region which exhibits plastic deformation and a second region exhibiting elastic deformation which appears in a region in which the compressive stress is higher than the compressive stress in the first region in a relationship between the compressive stress and the strain.

This change is also manifested in compression in the thickness direction of the resistor, and the compressive stress is also generated inside the bending point at the time of bending.

For example, when the resistor is bent along the insulating layer 3, a difference in distance corresponding to the curvature occurs between the inside and the outside of the bent portion of the resistor. The resistor mainly containing metal fibers narrows the air space inside to fill the difference in the distance. As a result, a compressive stress is generated inside the resistor at the bent portion.

Figure 6:
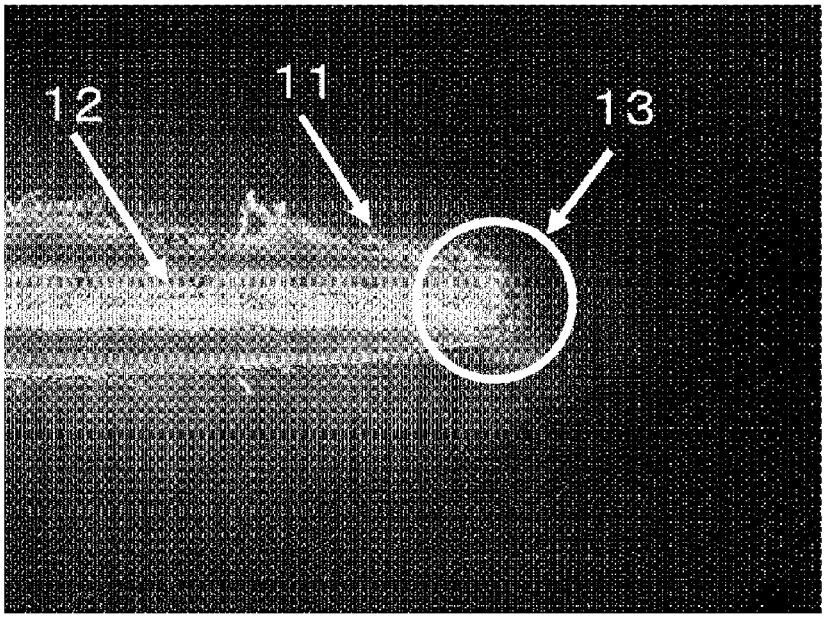
FIG. 6 is a photograph showing one embodiment in which a stainless fiber sintered nonwoven fabric which is an example of a resistor is bent along a glass epoxy plate according to the present invention.
Figure 7:
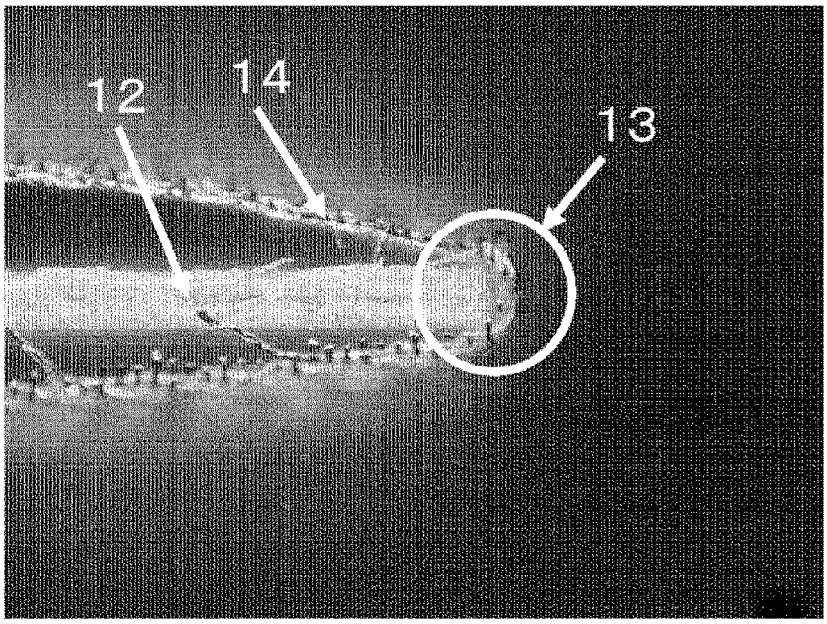
FIG. 7 is a photograph showing another embodiment in which a stainless fiber mesh, which is an example of a resistor is bent along a glass epoxy plate according to the present invention.
Figure 8:
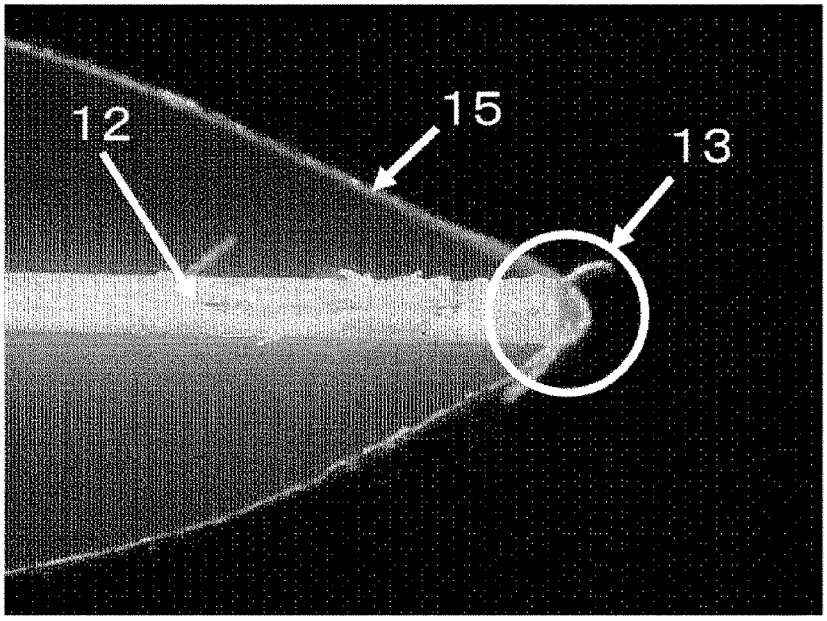
FIG. 8 is a photograph showing a stainless steel foil bent along a glass epoxy-plate.

FIGS. 6 to 8 are photographs showing a state in which a stainless fiber sintered nonwoven fabric 11, a stainless fiber woven fabric 14, or a stainless steel foil 15 is bent along the end portion 13 of a glass epoxy plate 12 (corresponding to the insulating layer 3) having a thickness of about 216 μm. When the end portion 13 is observed, it can be seen that the stainless fiber sintered nonwoven fabric 11 (FIG. 6) and the stainless woven fabric 14 (FIG. 7) follow the end portion 13 of the glass epoxy plate 12. In contrast, the stainless steel foil 15 (FIG. 8) has a gap at the end portion 13 of the glass epoxy plate 12.

Figure 9:
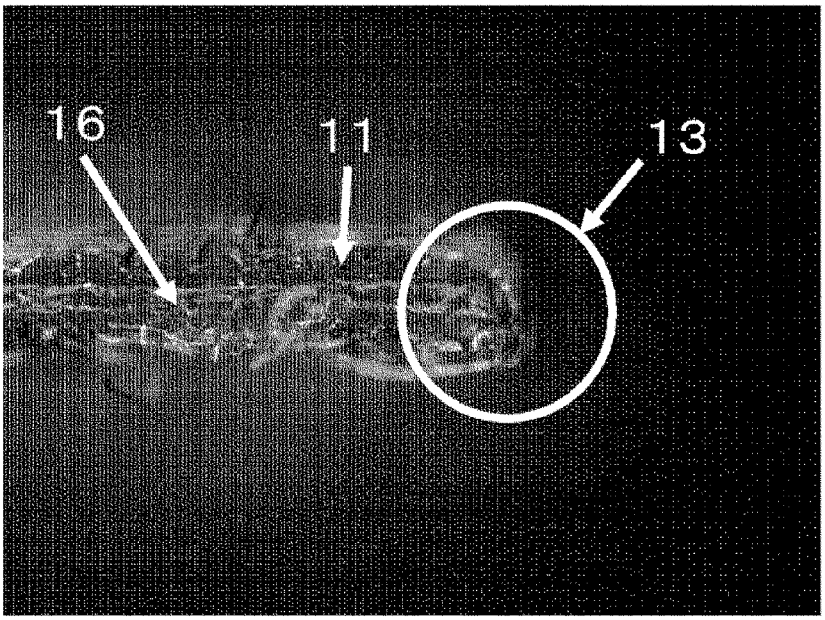
FIG. 9 is a photograph showing another embodiment of a resistor in which a stainless fiber sintered nonwoven fabric which is an example of a resistor is adhered to a double-sided adhesive PET film according to the present invention.
Figure 10:
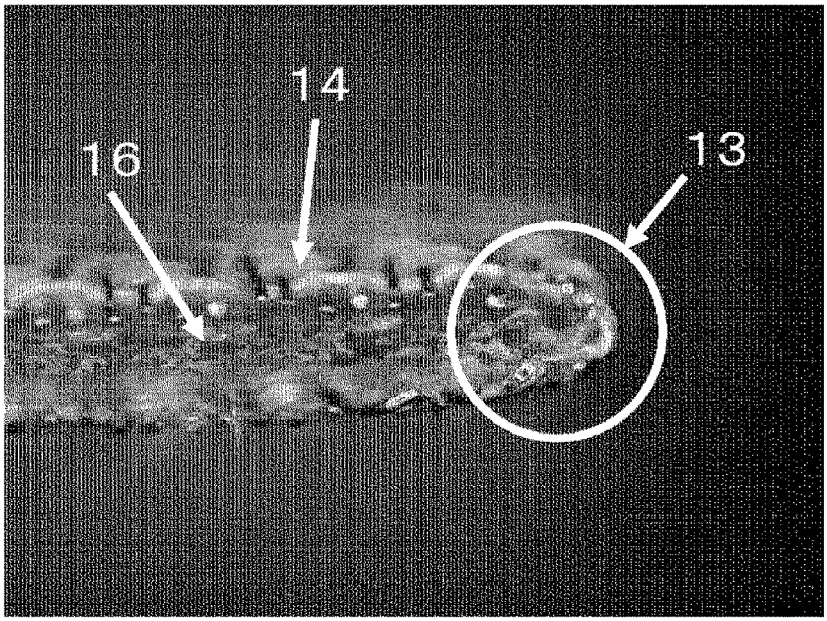
FIG. 10 is a photograph showing another embodiment of a resistor in which a stainless fiber mesh which is an example of a resistor is adhered to a double-sided adhesive PET film according to the present invention.
Figure 11:
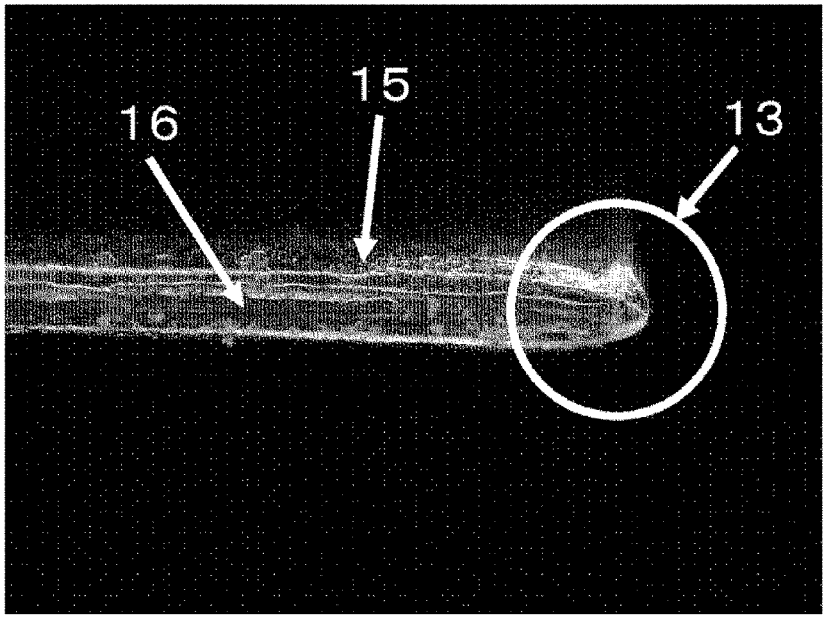
FIG. 11 is a photograph showing a state in which a stainless steel foil is adhered to a double-sided adhesive PET film.

These phenomena occur in a case in which the stainless fiber sintered nonwoven fabric 11 (FIG. 9), the stainless fiber woven fabric 14 (FIG. 10) or the stainless steel foil 15 (FIG. 11) is bent along the end portion of a double-sided adhesive PET film 16 (insulating layer 3) having a thickness of 100 μm.

That is, the stainless steel fiber sintered nonwoven fabric 11 and the stainless fiber woven fabric 14 which are the embodiments of the resistor 1, 4, and 5 containing mainly metal fibers used in the present invention have excellent followability to the end portion of the glass epoxy plate 12 and the double-sided adhesive PET film 16 which are the embodiments of the insulating layer 3 used in the present invention. There is no fear of an electrical short circuit, or the like which may be caused by the gap being generated between the resistor and the insulating layer 3. Furthermore, the productivity in realizing miniaturization is also excellent It is presumed that this phenomenon is caused by the fact that the stainless steel fiber sintered nonwoven fabric and the stainless steel fiber woven fabric have a plastic deformation region (first region) and then an elastic deformation region (second region) as the compressive stress increases in the relationship between the compressive stress and the strain, and/or that the stainless steel fiber sintered nonwoven fabric and the stainless steel fiber woven fabric have an inflection portion a of strain to the compressive stress in the elastic deformation region (second region).

Hereinafter, the plastic deformation (first region), the elastic deformation (second region), and the inflection portion a will be described.

The plastic deformation, the elastic deformation, and the inflection point a can be confirmed from a stress-strain curve obtained by carrying out a compression test in cycles of compression and release.

FIG. 14 is a graph showing measurement results of the compression test of the resistor used in the present invention (stainless fiber sintered nonwoven fabric: initial thickness: 1,020 μm) in cycles of compression and release. In the graph, the first to third times indicate the number of compressions, and the measurement values at the first compression, the second compression, and the third compression are plotted.

Since the resistor used in the present invention is plastically deformed by the first compression and release operation, the start position of the measurement probe at the second compression is lowered than that of the measurement probe at the non-compression.

In the present description, with the strain start value at the time of the existing compression (at the second or third compression) as a boundary, a lower strain side is defined as the plastic deformation region and a region after the plastic deformation region (higher strain side) is defined as the elastic deformation region.

In the graph of FIG. 14, the strain at the second compression, which is the strain start value, is about 600 μm.

From the measurement results shown in FIG. 14, it can be seen that the resistor has the first region A exhibiting plastic deformation and the second region B exhibiting elastic deformation at a boundary of strain 600 μm.

That is, as described above, the resistor used in the present invention preferably has the first region A exhibiting plastic deformation and then the second region B exhibiting elastic deformation as the compressive stress increases in the relationship between the compressive stress and the strain.

More specifically, when the strain in the second compression is taken as the strait start value, the resistor used in the present invention preferably has the plastic deformation region (first region) on the lower strain side than the strain of the start value, and the elastic, deformation region (second region) on the higher strain side with respect to the strain of the start value.

It is presumed that when the stainless fiber sintered nonwoven fabric and the stainless fiber woven fabric which can be used as the resistor in the present invention are bent following the end portion of the insulating layer 3 such as the glass epoxy plate 12, and the like, the stainless fiber sintered nonwoven fabric and the stainless fiber woven fabric deforms appropriately in the first area A exhibiting plastic deformation, and sufficiently Gallows the end portion 13 of the glass epoxy plate 12 by cushioning in the second area B exhibiting elastic deformation. Accordingly, it is possible to fill a slight gap generated between the stainless fiber sintered nonwoven fabric and the stainless steel fiber woven fabric and the end portion of the glass epoxy plate 12.

Figure 12:
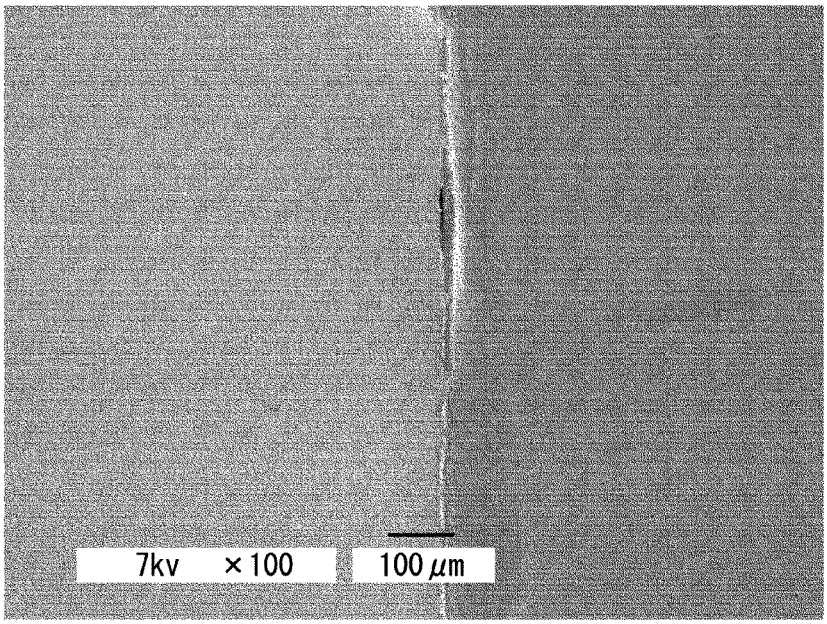
FIG. 12 is a photograph obtained by SEM observation of a bend portion of a stainless steel foil.

On the other hand, the stainless steel foil first undergo elastic deformation and then plastic deformation with respect to beading stress. That is, the stainless steel foil which has reached the elastic deformation limit at the bent portion causes a rapid shape change by plastic deformation (buckling). As a result, the gap is generated between the bent portion of the stainless steel foil and the end portion of the glass epoxy plate 12, for example. Further, it can be understood from the SEM photograph shown in FIG. 12 that apart of the bend portion of the stainless steel foil having a thickness of 20 μm is broken.

It is understood that since the elastic deformation first occurs, and then the plastic deformation occurs in the stainless steel foil, the stainless steel foil which has reached the buckling limit against the bending stress causes the plastic deformation, is in a bent state by causing the plastic deformation, and cannot sufficiently follow the end portion of the insulating layer, such as a glass epoxy plate.

Further, as described above, the resistor included in the resistor element of the present invention preferably has the inflection portion a of the strain with respect to the compressive stress in a region (second region) exhibiting elastic deformation.

Figure 15:
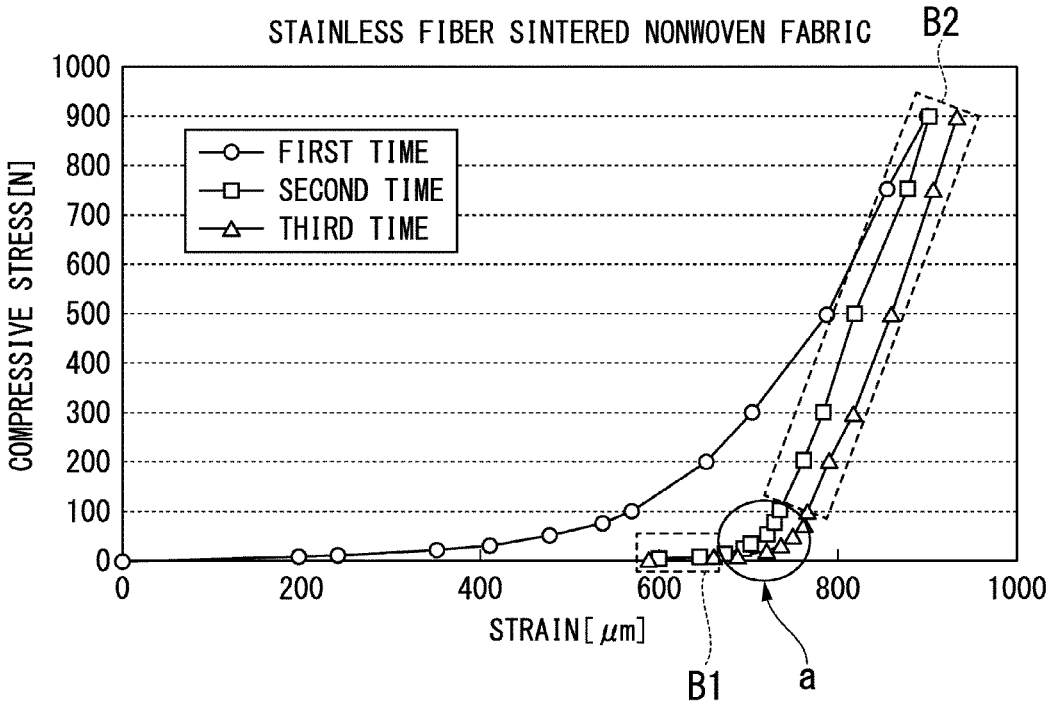
FIG. 15 is a graph for describing in detail a region exhibiting elastic deformation of a stainless liber sintered nonwoven fabric which is an example of a resistor used in the present invention.

FIG. 15 is a graph for describing in detail the region exhibiting elastic deformation of the resistor included in the resistor element according to the present invention, which uses the stainless fiber sintered nonwoven fabric used in the measurement of FIG. 14.

In FIG. 15, a region B1 exhibiting the elastic deformation and having a compressive stress lower than that of the inflection portion a is considered to be a so-called spring elastic region. A region B2 exhibiting elastic deformation and having a compressive stress higher than that of the inflection portion a is considered to be a so-called strain elastic region in which strain is accumulated inside the metal.

As shown in FIG. 15, since the stainless fiber sintered nonwoven fabric as an example of the resistor used in the present invention has the region B1 exhibiting elastic deformation and having a compressive stress lower than that of the inflection portion a and the region B2 exhibiting elastic deformation and having a compressive stress higher than that of the inflection portion a, it is possible to easily improve the shape followability, and easily miniaturize the resistor element.

In such a resistor, the resistor is appropriately deformed in the elastic deformation region B1 having a larger change in strain with respect to compressive stress than that in the inflection portion a, and closely follows the end portion of the insulating layer in the deformation region B2 having a lower change in strain with respect to compressive stress than that in the inflection portion a.

When the resistor used in the present invention has an inflection portion a in the second region B exhibiting clastic deformation, the resistor may have the first region exhibiting plastic deformation before the second region B exhibiting clastic deformation in the relationship between the compressive stress and the strain.

As described above, the plastic deformation and the elastic deformation can be confirmed from the stress-strain curve obtained by performing a compression test in cycles of compression and release.

The measurement method of the compression test In the cycles of compression and release can be performed using, for example, a tensile and compressive stress measurement tester. First, a 30 mm square test piece is prepared. The thickness of the test piece prepared is measured using Mitutoyo manufactured Digimatic indicator ID-C112X as the thickness before the compression test.

The micrometer can raise and lower a probe by air, and the speed can be arbitrarily adjusted. Since the test piece is in a state of being easily crushed by a small amount of stress, when lowering the measurement probe, the measurement probe is slowly dropped so that only the weight of the probe is applied to the test piece. In addition, the probe is applied only once. The thickness measured at this time is "thickness before a test."

Then, a compression test is performed using a test piece. A 1 kN load cell is used. As a jig used in the compression test, a compression probe made of stainless steel and having a diameter of 100 mm is used. The compression speed is adjusted to 1 mm/min, and the test piece is compressed and released three times. Thereby, it is possible to confirm the plastic deformation, tire elastic deformation, the inflection portion a and the like of the resistor used in the present invention.

The actual strain to the compressive stress is calculated from the "stress-strain curve" obtained by the test, and the amount of the plastic deformation is calculated according to the following equation.

Plastic deformation amount=(strain at rising portion of first compression)−(strain at rising portion of second compression)

Moreover, the rising portion refers to strain at 2.5N. The thickness of the test piece after the test is measured in the same manner as described above, and the measured thickness is taken as the "thickness after test".

In the resistor used in the present invention, the plastic deformation rate is preferably within a desired range. The plastic deformation rate indicates the degree of the plastic deformation of the resistor.

In the present description, the plastic deformation rate (for example, the plastic deformation rate when the load is gradually increased from 0 MPa to 1 MPa) is defined as follows.

$$\text{Plastic deformation amount } (\mu m) = T0 - T1$$

$$\text{Plastic deformation rate } (\%) = [(T0 - T1)/T0] \times 100$$

The above T0 is the thickness of the resistor before applying a load. The above T1 is the thickness of the resistor after the load is applied and released.

The plastic deformation rate of the resistor used in the present invention is preferably 1% to 90%, more preferably 4% to 75%, particularly preferably 20% to 55%, and most preferably 20% to 40%. When the plastic deformation rate is 1% to 90%, better shape followability can be obtained, and thereby miniaturization of the resistor element can be easily achieved.

(Production of Resistor)

As a method of producing the resistor used in the present invention, a dry method, in which a web made of the metal fibers or a web mainly made of the metal fibers is compressed to mold, a method of weaving the metal fibers, and a wet sheet-making method in which a raw material made of the metal fibers or of a raw material mainly made of the metal fibers is used.

In the case of producing the resistor used in the present invention by the dry method, a web made of the metal fibers or a web mainly made of the metal fibers obtained by a card method, air laid method or the like can be compression molded.

At this, time, a binder may be impregnated between the fibers to make bonding between the fibers. Such a binder is not particularly limited, but examples of the binder include organic binders such as acrylic adhesives, epoxy adhesives and urethane adhesives, and inorganic adhesives such as colloidal silica, water glass and sodium silicate.

Instead of impregnating the binder, the surface of the fibers may be coated with a heat-adhesive resin in advance, and an assembly made of the metal fibers or an assembly mainly made of the metal fibers may be laminated, followed by pressure and heat compression.

The method of preparing the resistor by weaving the metal fibers can be finished in the form of plain weave, twill weave, cedar weave, tatami weave, triple weave, and the like by the same method as the machine weave.

Alternatively, the resistor used in the present invention can be produced by a wet sheet-making method in which the metal fibers and the like are dispersed in water and the resulting sheet is formed.

The wet sheet-making method fora metal liber nonwoven fabric includes a slurry preparation step in which a fibrous material such as the metal fibers is dispersed in water to prepare a sheet forming slurry, a sheet-making step in which a wet sheet is produced by the sheet forming slurry, a dewatering step in which the wet sheet is dewatered, and a drying step in which the sheet after dewatering is dried to produce a dried sheet.

Each step will be described below.

(Slurry Preparation Step)

A pre-slurry only containing the metal fibers or a pre-slurry mainly containing the metal fibers is prepared, and fillers, dispersants, thickeners, antifoaming agents, sheet strength agents, sizing agents, flocculants, coloring agents, fixing agents, or the like are appropriately added into the pre-slurry to produce a shiny.

In addition, as fibrous material other than the metal fibers, organic fibers which exhibits binding properties by heating and melting, for example, polyolefin resin such as polyethylene resin and polypropylene resin, polyethylene terephthalate (PET) resin, polyvinyl alcohol (PVA) resin, polyvinyl chloride resin, aramid resin, nylon, and acrylic resin can be added into the slurry.

(Sheet-Making Step)

Next, a sheet-making step is carried out using the slurry and a sheet-making machine. As the sheet making machine, it is possible to use a cylinder sheet-making machine, a fourdrinier sheet-making machine, a TANMO sheet-making machine, an inclined type sheet-making machine or a combination of the same or different types of these sheet-making machines.

(Dewatering Step)

Next, the sheet after sheet-making step is dewatered. At the time of dewatering, it is preferable to equalize the water flow rate of dewatering (dewatering amount) in the plane, the width direction, and the like of the sheet-making net. By making the water flow rate constant, turbulent flow and the like at the time of dewatering can be limited. Accordingly, since the rate at which metal fibers settle to the sheet-making net can be made uniform, it is easy to obtain a highly homogeneous resistor.

In order to make the water flow rate at the time of dewatering constant, it is possible to take measures such removing a structure which may be an obstacle to the water flow under the sheet-making net. As a result, it is easy to obtain a resistor having a smaller in-plane variation, a more precise and uniform bending characteristic. Thereby, it is possible to obtain the effect of facilitating high-density mounting of the resistor element.

(Drying Step)

Next, the sheet after the dewatering step is dried using an air dryer, a cylinder dryer, a suction drum dryer, an infrared dryer, or the like.

Through these steps, a sheet mainly containing metal fibers can be obtained.

The resistor can be obtained through the above steps. In addition to the above steps, it is preferable to adopt the following steps.

(Fiber Entanglement Step)

When the resistor is produced by the wet sheet-making method, it is preferable to produce the resistor through a liber entanglement step in which the metal fibers or the component mainly containing the metal fibers which are contained in the sheet containing a water on the net of the sheet-making machine are mutually entangled. That is, when adopting the fiber entanglement step, the fiber entanglement step is performed after the sheet-making step.

In the fiber entanglement step, for example, it is preferable to jet a high-pressure jet water stream to the wet surface of the metal fibers on the sheet-making net. Specifically, it is possible to entangle metal fibers or fibers mainly containing metal fibers over the entire wet body by arranging a plurality of nozzles in the direction orthogonal to the flow direction of the wet body and jetting high-pressure jet streams simultaneously from a plurality of the nozzles.

Since the fibers are entangled by the fiber entanglement step, it is possible to obtain a uniform resistor with less so-called lump. It is suitable for high density mounting.

(Fiber Binding Step)

It is preferable that the metal fibers of the resistor be bonded to each other. As a step of bonding metal fibers together, a step of sintering the resistor, a step of bonding by chemical etching, a step of laser welding, a step of bonding using IH heating, a chemical bonding step, a thermal bonding step, or the like can be used. However, the method of sintering the resistor can be used suitably for stabilization of resistance value.

Figure 13:
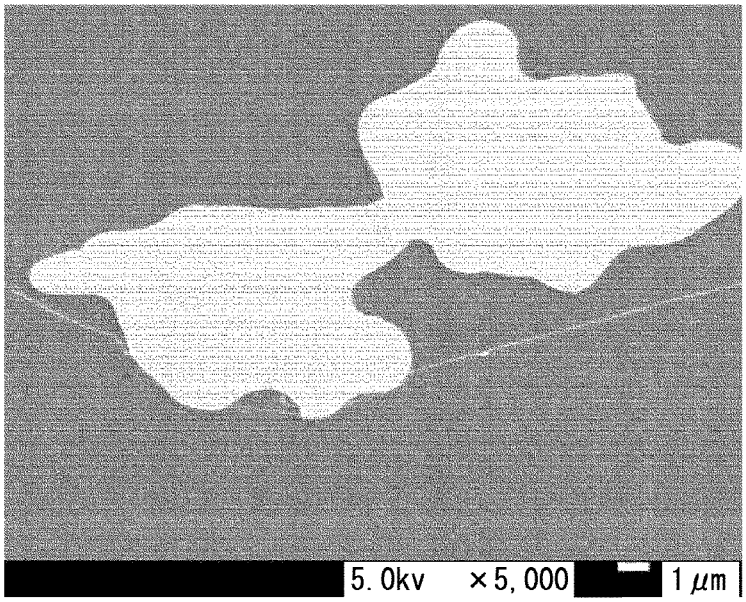
FIG. 13 is an SEM cross-sectional photograph showing a state in which stainless fibers used in the present invention is sintered.

FIG. 13 is a SEM observation of a cross section of a stainless fiber resistor in which the stainless fibers are bound by sintering. It can be seen that the stainless steel fibers are sufficiently bound.

In the present description, "bound" refers to a state in which the metal fibers are physically fixed. The metal fibers may be directly fixed to each other, the metal fibers may also be fixed to each other by the second metal component containing metal component different from the metal components of the metal fibers, or a part of the metal fibers may be fixed by a component other titan a metal component.

In order to sinter the resistor used in the present invention, it is preferable to include a sintering step of sintering at a temperature below the melting point of the metal fibers in vacuum or in a non-oxidizing atmosphere. The organic material is burned off in the resistor after the sintering process. In this way, when the contacts between the metal fibers of the resistor containing only the metal fibers are bound, for example, the resistor element in which the first and second resistors are continuous can obtain better shape followability to the insulating layer, and easily a stable resistance value. In the present description, "sintered" refers to a state in which the metal fibers are bonded while leaving a fiber state before heating.

The resistance value of the resistor produced in this way can be arbitrarily adjusted by the type, thickness, density, and the like of the metal fibers. However, the resistance value of the sheet shaped resistor obtained by sintering the stainless fibers is, for example, about 50 to 300 m Ω/□.

(Pressing Step)

Pressing may be carried out under heating or non-beating conditions, but when the resistor used in the present invention contains an organic fiber or the like which exhibits binding property by heating and melting, it is effective to heat at temperatures equal to the melting start temperature of the organic fiber or the like or more. When the resistor contains the metal fibers alone or the resistor contains the second metal component, only pressurization may be performed. Furthermore, the pressure at the time of pressurization may be appropriately set in consideration of the thickness of the resistor. In addition, the space factor of the resistor can be adjusted by the pressing step. The pressing step can be performed between the dewatering step and the drying step, between the drying step and the binding step, and/or after the binding step.

When the pressing (pressurizing) step is performed between the drying step and the binding step, it is easy to reliably provide the binding portion in the subsequent binding step (it is easy to increase the number of binding points). In addition, it is easier to obtain the first region exhibiting plastic deformation and the second region exhibiting elastic deformation which appears in a region where the compressive stress is higher than that of the first region. Furthermore, since it is easier to obtain the inflection portion a in the region exhibiting elastic deformation, it is preferable in that it becomes easy to give the shape flowability to the resistor used in the present invention.

After sintering (after the binding step), the pressing step can be performed to further enhance the uniformity of the resistor. The resistor in which the fibers are randomly entangled is compressed in the thickness direction, the fibers are shifted not only in the thickness direction but also in the surface direction. As a result, the effect of facilitating the placement of the metal fibers at the place where the airspace is formed at the time of sintering can be expected, and the state is maintained by the plastic deformation characteristics of the metal fibers. As a result, it is possible to obtain a finer and thinner resistor with less in-plane variation and the like. This has the effect of facilitating high-density mounting of the resistor element.

(Electrode 2)

The electrode 2 used in the present invention may be made of the same metal as the resistor 1 or may be made of another kind of metal, for example stainless steel, aluminum, brass copper, iron, platinum, gold, tin, chromium, lead, titanium, nickel, manganin, nichrome and the like. The electrode 2 may be formed in such a manner that the current flowing in the resistor mainly containing metal fibers can be reliably transmitted. For example, the electrode 2 can be produced by heating or chemically melting the metal to form reliably contacts with the metal fibers.

(Insulating Layer 3)

Any insulating layer 3 may be used in the present invention as long as it has the effect of blocking the current supplied to the resistor or the electrode 2. For example, glass epoxy, a resin sheet having an insulating property, a ceramic material or the like can be used. Above all, a double-sided adhesive PET film can be suitably used in that it is easy to integrate with the resistor.

(Connection Portion 10)

As shown in FIG. 2, the resistor used in the present invention can also have the connection portion 10.

The material of the connection portion 10 may be any material which can electrically connect the first resistor 4 and the second resistor 5 to each other. For example, metal materials such as stainless steel, copper, lead, nichrome and the like can be suitably used.

It is preferable that the outside of the resistor element of the present invention be sealed by an insulating material. The sealing may be performed by any methods using any materials such as applying an insulating coating as long as insulation can be ensured, in addition to dipping into a molten resin, bonding, and the like.

As described above, according to the present invention, since miniaturization of the resistor element is achieved, it is possible to provide a resistor clement capable of coping with further high density mounting and coping with a wide range of the resistance value setting.

EXPLANATION OF REFERENCE NUMERAL

1 resistor
2 electrode
3 insulating layer
4 first resistor
5 second resistor
6, 8 current direction
7 magnetic field generated by current 6
9 magnetic field generated by current 8
10 connection portion
11 stainless steel fiber sintered nonwoven fabric
12 glass epoxy plate
13 end portion
14 stainless steel woven fabric
15 stainless steel foil
16 PET film with adhesive on both sides
A first region exhibiting plastic deformation
B second region exhibiting clastic deformation
B1 elastic deformation area with lower compressive stress than inflection point a
B2 elastic deformation area with higher compressive stress than inflection point a
a inflection portion
100 resistor element

The invention claimed is:

1. A resistor element including a resistor which mainly contains metal fibers, electrodes which are formed at an end portion of the resistor, and an insulating layer which is in contact with the resistor and the electrodes, wherein the resistor has a first region exhibiting plastic deformation and a second region exhibiting elastic deformation which appears in a region in which a compressive stress is higher than a compressive stress in the first region in a relationship between a compressive stress and a strain.

2. The resistor element according to claim 1, wherein the resistor has an inflection portion a of strain with respect to the compressive stress in the second region exhibiting elastic deformation.

3. The resistor element according claim 1, wherein the resistor is a stainless fiber sintered body.

4. A resistor element including:

a connection portion;

first and second resistors which mainly contain metal fibers and are electrically connected to each other at the connection portion;

an electrode which is electrically connected to at least one of the first resistor and the second resistor; and an insulating layer which prevents an electrical connection between the first resistor and the second resistor, and an application direction of voltage of the first resistor and an application direction of voltage of the second resistor are different from each other.

5. The resistor element according to claim 4, wherein the connection portion, the first resistor, and the second resistor are continuous.

6. The resistor element according to claim 4, wherein the application direction of voltage of the first resistor and the application direction of voltage of the second resistor are opposed or substantially opposed each other.

7. The resistor according to claim 4, wherein the first resistor and the second resistor have a first region exhibiting plastic deformation and a second region exhibiting elastic deformation which appears in a region in which a compressive stress is higher than a compressive stress in the first region in a relationship between a compressive stress and a strain.

8. The resistor element according to claim 4, wherein the first resistor and the second resistor have an inflection portion a of strain with respect to compressive stress in the second region exhibiting elastic deformation.

9. The resistor element according to claim 4, wherein the first resistor and the second resistor are a stainless fiber sintered body.

* * * * *